US006880534B2

(12) United States Patent
Yoshiki et al.

(10) Patent No.: US 6,880,534 B2
(45) Date of Patent: Apr. 19, 2005

(54) EVAPORATIVE FUEL PROCESSING SYSTEM

(75) Inventors: Koichi Yoshiki, Wako (JP); Kazuhiko Imamura, Wako (JP); Ryuji Kohno, Wako (JP); Mahito Shikama, Wako (JP); Toshiichi Terakado, Wako (JP); Kenichi Maeda, Wako (JP); Masayuki Wakui, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/870,937

(22) Filed: Jun. 21, 2004

(65) Prior Publication Data

US 2005/0011498 A1 Jan. 20, 2005

(30) Foreign Application Priority Data

Jul. 8, 2003 (JP) ..... 2003-271710
Jul. 17, 2003 (JP) ..... 2003-276310

(51) Int. Cl.[7] ..... F02M 25/08

(52) U.S. Cl. ..... 123/520; 123/533; 701/102; 701/104

(58) Field of Search ..... 123/516, 518, 123/519, 520, 521, 531, 533; 701/102, 104

(56) References Cited

U.S. PATENT DOCUMENTS 4,530,210 A * 7/1985 Yamazaki ..... 60/605.1
5,005,550 A * 4/1991 Bugin et al. ..... 123/520
5,054,454 A * 10/1991 Hamburg ..... 123/520
5,103,794 A * 4/1992 Shiraishi ..... 123/520
5,245,974 A * 9/1993 Watson et al. ..... 123/518
5,754,971 A * 5/1998 Matsumoto et al. ..... 701/103
6,196,202 B1 * 3/2001 Busato et al. ..... 123/520

FOREIGN PATENT DOCUMENTS

JP 63-162965 10/1988

* cited by examiner

*Primary Examiner*—Weilun Lo
(74) *Attorney, Agent, or Firm*—Arent Fox, PLLC

(57) ABSTRACT

An evaporative fuel processing system for processing evaporative fuel generated a fuel tank. A canister temporarily stores evaporative fuel generated in the fuel tank. A charge passage connects the fuel tank and the canister. A first purge passage connects the canister and an intake pipe of an internal combustion engine having a turbocharger. A purge control valve is provided in the first purge passage for adjusting a flow rate of gases flowing through the first purge passage. A second purge passage connects a downstream side of the purge control valve of the first purge passage and an upstream side of the turbocharger of the intake pipe. A jet pump is mounted on the second purge passage. A pressurized air supply passage supplies air pressurized by the turbocharger to the jet pump. The jet pump includes a nozzle for discharging the pressurized air supplied through the pressurized air supply passage.

9 Claims, 4 Drawing Sheets

EVAPORATIVE FUEL PROCESSING SYSTEM

BACKGROUND OF THE INVENTION

1. Field of the Invention

The present invention relates to an evaporative fuel processing system which temporarily stores evaporative fuel generated in a fuel tank, and timely supplies the evaporative fuel to an intake system of an internal combustion engine, and particularly to an evaporative fuel processing system which supplies the evaporative fuel to an internal combustion engine having a turbocharger.

2. Description of the Related Art

In Japanese Utility Model Laid Open Sho 63-162965, an evaporative fuel processing system which supplies evaporative fuel to an intake pipe of an internal combustion engine having a turbocharger is disclosed. In the internal combustion engine having a turbocharger, the intake pressure at a portion downstream of the turbocharger becomes higher than the atmospheric pressure when the turbocharger is operating. Therefore, the evaporative fuel stored in the canister cannot be sufficiently purged to the intake pipe only by a usual purge passage which supplies the evaporative fuel to a portion downstream of the throttle valve.

Therefore, in the system disclosed in Japanese Utility Model Laid Open Sho 63-162965, a connecting passage that has a venturi part and connects an upstream side and a downstream side of the turbocharger (compressor) is mounted on the intake pipe. The purge passage is connected from a canister storing evaporative fuel and the connecting passage, and opens at the venturi part of the connecting passage. This system is configured so that the evaporative fuel may be supplied from the canister to the intake pipe via the connecting passage during operation of the turbocharger, by a negative pressure generated in the venturi part.

However, it is confirmed by experiments that a sufficient negative pressure cannot be obtained only by disposing the venturi part in the connection passage, so that the evaporative fuel is hardly supplied to the intake pipe, or the supplied fuel amount is a very small even if the evaporative fuel can be supplied to the intake pipe.

Further, if the evaporative fuel is supplied to the upstream side of the turbocharger, the intake air and the evaporative fuel is mixed and an evaporative-fuel concentration in the air-fuel mixture may reach a flammability limit. When the evaporative-fuel concentration reaches the flammability limit, there is a possibility that the air-fuel mixture may actually ignite with the heat generated in a compressor and a turbine of the turbocharger.

SUMMARY OF THE INVENTION

One embodiment of the present invention provides an evaporative fuel processing system which can purge a comparatively large amount of evaporative fuel to the intake system of the engine during the turbocharger operation.

A second embodiment of the present invention provides an evaporative fuel processing system which can prevent ignition of the air-fuel mixture containing evaporative fuel, when purging a comparatively large amount of evaporative fuel to the intake system during the turbocharger operation.

The present invention provides an evaporative fuel processing system including a fuel tank (10), a canister (12), a charge passage (11), a first purge passage (13), and a purge control valve (14). The canister (12) temporarily stores evaporative fuel generated in the fuel tank (10). The charge passage (11) connects the fuel tank (10) and the canister (12). The first purge passage (13) connects the canister (12) and an intake pipe (2) of an internal combustion engine (1) having a turbocharger (5). The purge control valve (14) is provided in the first purge passage (13) for adjusting a flow rate of gases flowing through the first purge passage (13). The evaporative fuel processing system further includes a second purge passage (15, 16), a jet pump (17) mounted on the second purge passage, and a pressurized air supply passage (18). The second purge passage (15, 16) connects a downstream side of the purge control valve (14) of the first purge passage (13) and an upstream side of the turbocharger (5) of the intake pipe (2). The pressurized air supply passage (18) supplies air pressurized by the turbocharger (5) to the jet pump (17). The jet pump (17) includes a nozzle (21) for discharging the pressurized air supplied through the pressurized air supply passage (18), and a casing (22) surrounding the nozzle (21) with a space (23) therebetween. The space (23) constitutes a part of the second purge passage.

With this configuration, when the air pressurized by the turbocharger is discharged from the nozzle of the jet pump, a flow is generated by the discharging air flow, due to the viscosity of the discharging air, and this flow generates a negative pressure. Accordingly, without the pressurized air flowing upstream of the second purge passage, the air-fuel mixture containing evaporative fuel is attracted from upstream of the second purge passage, and emitted from the jet pump, thereby supplying the air-fuel mixture upstream of the turbocharger in the intake pipe. Consequently, the evaporative fuel can be purged during turbocharger operation from the canister to the intake pipe, thereby preventing the evaporative fuel from accumulating in the canister.

Preferably, the nozzle (21) of the jet pump (17) is slidably fitted in the casing (22), and a discharge aperture **(21*a*) of the nozzle (21) moves away from an exhaust port (22*b*) of the jet pump (17)** as a pressure of the pressurized air becomes higher.

Preferably, the nozzle (21) has a flange **(21*b*), and the flange (21*b*) and the casing (22) define a pressure chamber (25). Further, at least one spring (27) is inserted between the flange (21*b*) and the casing (22) so that the nozzle (21) is biased toward the exhaust port (22*b*) of the jet pump (17), and the air pressurized by the turbocharger (5) is supplied to the pressure chamber (25)**.

Preferably, the evaporative fuel processing system further includes purge control means (28), evaporative-fuel concentration detecting means (19), boost pressure detecting means (8), intake air flow rate detecting means (7), and evaporative-fuel concentration calculating means (29). The purge control means controls an opening of the purge control valve (14) according to an operating condition of the engine (1). The evaporative-fuel concentration detecting means (19) detects an evaporative-fuel concentration (V1) in an air-fuel mixture containing evaporative fuel emitted from the canister (12). The boost pressure detecting means (8) detects a boost pressure (P2) of the turbocharger (5). The intake air flow rate detecting means (7) detects an intake air flow rate (QAIR) of the engine (1). The evaporative-fuel concentration calculating means (29) calculates an intake evaporative-fuel concentration (V2) in the air-fuel mixture at an upstream side of the turbocharger (5) as an intake evaporative-fuel concentration, according to the detected evaporative-fuel concentration (V1), boost pressure (P2), and intake air flow rate (QAIR). The purge control means (28) decreases the opening of the purge control valve (14) when the intake evaporative-fuel concentration (V2)

exceeds a predetermined concentration (V2TH) during operation of the turbocharger (5).

With this configuration, the intake evaporative-fuel concentration, which is an evaporative-fuel concentration upstream of the turbocharger, is calculated, and the control for decreasing the opening of the purge control valve is performed when the intake evaporative-fuel concentration exceeds the predetermined concentration during turbocharger operation. Therefore, the intake evaporative-fuel concentration can be controlled to maintain a value below the predetermined concentration, which makes it possible to prevent the air-fuel mixture containing the evaporative fuel from igniting.

Preferably, the predetermined concentration (V2TH) is set corresponding to a minimum value of flammability limit concentrations of ingredients contained in the evaporative fuel.

Additional advantages and novel features of the invention are set forth in the attachments to this Summary, and, in part, will become more apparent to those skilled in the art upon examination of the following or upon learning by practice of the invention.

DETAILED DESCRIPTION OF THE INVENTION

Preferred embodiments of the present invention will now be described with reference to the drawings.

Figure 1:
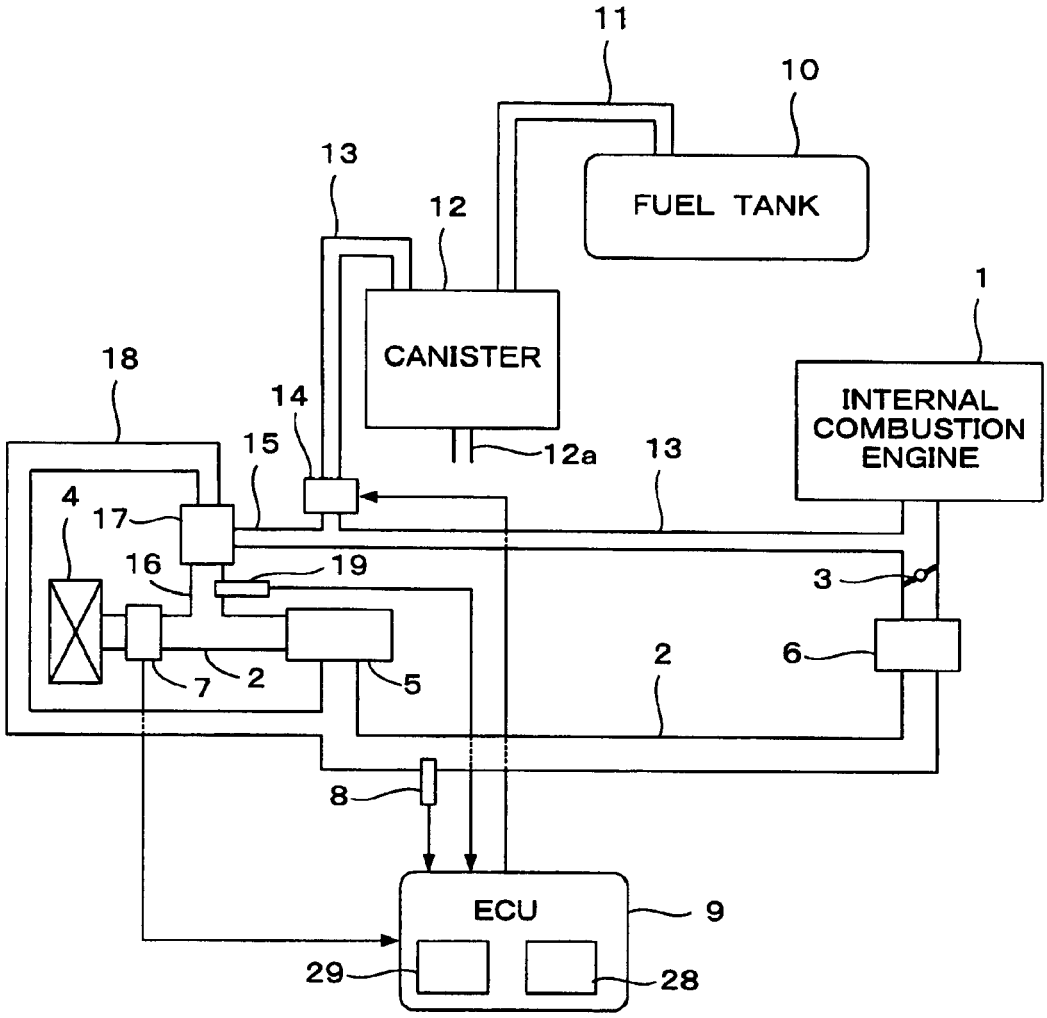
FIG. 1 is a schematic diagram showing a configuration of an evaporative fuel processing system according to an embodiment of the present invention.

FIG. 1 is a schematic diagram showing a configuration of an evaporative fuel processing system according to one embodiment of the present invention, and an intake system of an internal combustion engine. An internal combustion engine (hereinafter "engine") 1 has an intake pipe 2, and the intake pipe 2 is provided with an air cleaner 4, a turbocharger 5, an intercooler 6, and a throttle valve 3 in this order an upstream direction. The turbocharger 5 has a turbine rotationally driven by the exhaust gas energy, and a compressor which is rotated by the turbine and pressurizes intake air. The turbocharger 5 discharges pressurized air downstream in the intake pipe 2.

A fuel tank 10 is connected to a canister 12 through a charge passage 11, and the canister 12 is connected through a first purge passage 13 to a portion of the system downstream of the throttle valve 3 in the intake pipe 2.

The canister 12 contains an adsorbing material, such as, for example, activated carbon for adsorbing evaporative fuel generated in the fuel tank 10. An air passage 12*a* is connected to the canister 12, and the canister 12 communicates with the atmosphere through the air passage 12*a*.

The first purge passage 13 is provided with a purge control valve 14. The purge control valve 14 can be an electromagnetic valve configured so that a flow rate can be continuously controlled by changing the ON-OFF duty ratio of the control signal supplied thereto (by changing an opening of the control valve). The purge control valve 14 is connected to an electronic control unit (hereinafter "ECU") 9. The ECU 9 includes a purge control member 28 that controls an opening of the purge control valve 14 according to the operating condition of the engine 1.

The first purge passage 13 branches off to a passage 15 at a portion downstream of the purge control valve 14, and the passage 15 is connected by the jet pump 17 and the passage 16 to a portion of the intake pipe 2 upstream of the turbocharger 5. That is, a second purge passage is formed of the passages 15 and 16. The jet pump 17 is connected by a pressurized air supply passage 18 to a portion of the intake pipe 2 downstream of the turbocharger 5. The air pressurized by the turbocharger 5 is supplied to the jet pump 17 through the pressurized air supply passage 18. The jet pump 17 does not sufficiently function if there is any resistance at the exhaust side of the jet pump 17. Therefore, the passage 16 connected to the exhaust side of the jet pump 17 can be made larger than a passage entering the jet pump 17 and extend linearly from the jet pump 17.

The fuel tank 10, the charge passage 11, the canister 12, the first purge passage 13, the purge control valve 14, the passages 15 and 16 (second purge passage), the jet pump 17, and the pressurized air supply passage 18 constitute the evaporative fuel processing system.

If a large quantity of evaporative fuel is generated upon refueling of the fuel tank 10, the generated evaporative fuel can be stored in the canister 12. In a predetermined operating condition of the engine 1, the duty control of the purge control valve 14 is performed, and a proper quantity of the evaporative fuel is supplied from the canister 12 to the intake pipe 2.

The passage 16 is provided with an evaporative-fuel concentration sensor 19 for detecting a concentration (this is a volume concentration, hereinafter "first vapor concentration") V1 of the evaporative fuel supplied to the intake pipe 2. Further, an intake air flow rate sensor 7 for detecting an intake air flow rate QAIR is disposed immediately downstream of the air cleaner 4 in the intake pipe 2, and a boost pressure sensor 8 for detecting a pressurized air pressure (hereinafter "boost pressure") P2 is disposed downstream of the turbocharger 5 of the intake pipe 2. The detection signals of these sensors are supplied to the ECU 9.

Figure 2:
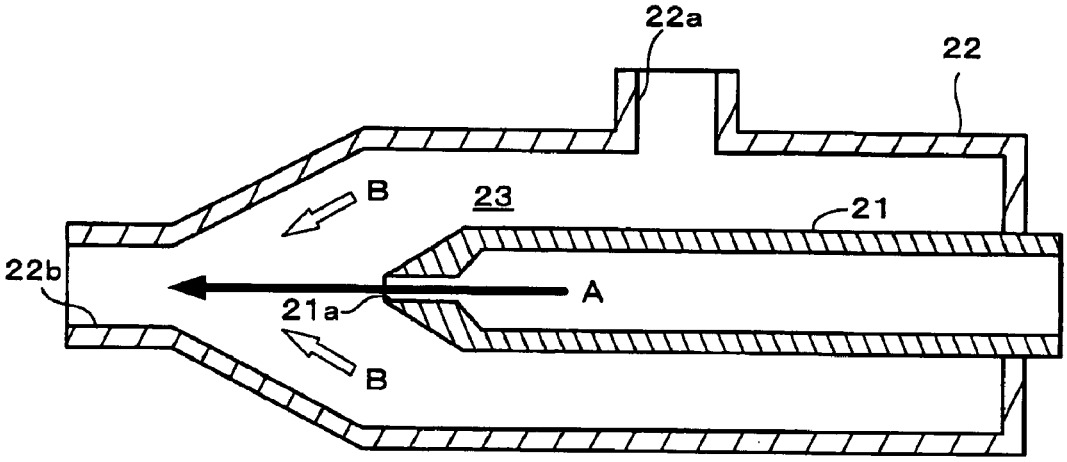
FIG. 2 is a sectional view showing a configuration of the jet pump shown in FIG. 1 in accordance with the present invention.

FIG. 2 is a sectional view showing one configuration of the jet pump 17. The jet pump 17 includes a cylindrical nozzle 21 and a casing 22. The cylindrical nozzle 21 is connected to the pressurized air supply passage 18, and discharges the pressurized air. The casing 22 surrounds the nozzle 21 with a space 23 therebetween. The nozzle 21 has a discharge aperture 21*a* through which the pressurized air is discharged. The casing 22 has an intake port 22*a* connected to the passage 15, and an exhaust port 22*b* connected to the passage 16. The space 23 forms a part of the second purge passage.

When the air pressurized by the turbocharger 5 is discharged from the nozzle 21 of the jet pump 17 (refer to the arrow A in FIG. 2), a flow (refer to the arrow B in FIG. 2) from the intake port 22*a* to the exhaust port 22*b* is generated by the discharging air flow, due to the viscosity of the discharging air, so that a negative pressure is generated. Accordingly, without the pressurized air flowing into the passage 15, the air-fuel mixture containing evaporative fuel would be attracted from the passage 15 through the intake port 22*a*, and emitted with the pressurized air to the passage 16 through the exhaust port 22*b*. The air-fuel mixture emitted from the jet pump 17 is supplied to the upstream side of the turbocharger 5 of the intake pipe 2. Consequently, the evaporative fuel can be purged during the turbocharger operation from the canister 12 to the intake pipe 2, thereby preventing the evaporative fuel from accumulating in the canister 12.

Figure 3:
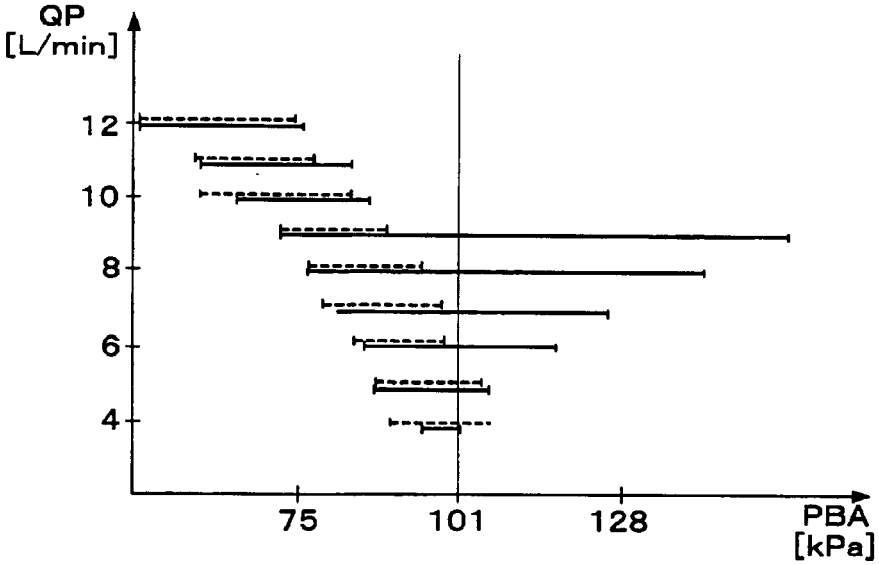
FIG. 3 is a graph showing a relationship between an intake pressure (PBA) and a purge flow rate (QP) in accordance with the present invention.

FIG. 3 is a graph showing ranges of an absolute intake pressure PBA (an absolute intake pressure at a portion downstream of the throttle valve 3) where the evaporative fuel can be purged, corresponding to values of the purge flow rate QP. The ranges indicated by the broken lines correspond to the instance where the second purge passages 15 and 16, and the jet pump 17 are not provided, while the ranges indicated by the solid lines correspond to the present embodiment. As shown in FIG. 3, according to the present embodiment, the absolute intake pressure range in which the evaporative fuel can be purged can be largely expanded, thereby making it possible to certainly purge the evaporative fuel adsorbed in the canister 12.

The ECU 9 includes an input circuit, a central processing unit (hereinafter referred to as "CPU"), a memory circuit, and an output circuit. The input circuit has various functions, such as a function of shaping the waveforms of the input signals received from the various sensors, a function of correcting the voltage levels of the input signals to a predetermined level, and a function of converting the analog signal values into digital signal values. The memory circuit preliminarily stores various operational programs to be executed by the CPU and stores the results of the computations or the like by the CPU. The output circuit supplies a drive signal to the purge control valve. The ECU 9 is supplied with engine operating parameters such as an engine rotational speed NE, an engine coolant temperature TW, an intake air temperature TA, etc. which are detected by sensors (not shown).

The CPU in the ECU 9 calculates a duty ratio DOUTPGC of the control signal supplied to the purge control valve 14 based on the detection signals from the various sensors. The control signal having the calculated duty ratio DOUTPGC is supplied to the purge control valve 14, and the opening of the purge control valve 14 is controlled.

Figure 4:
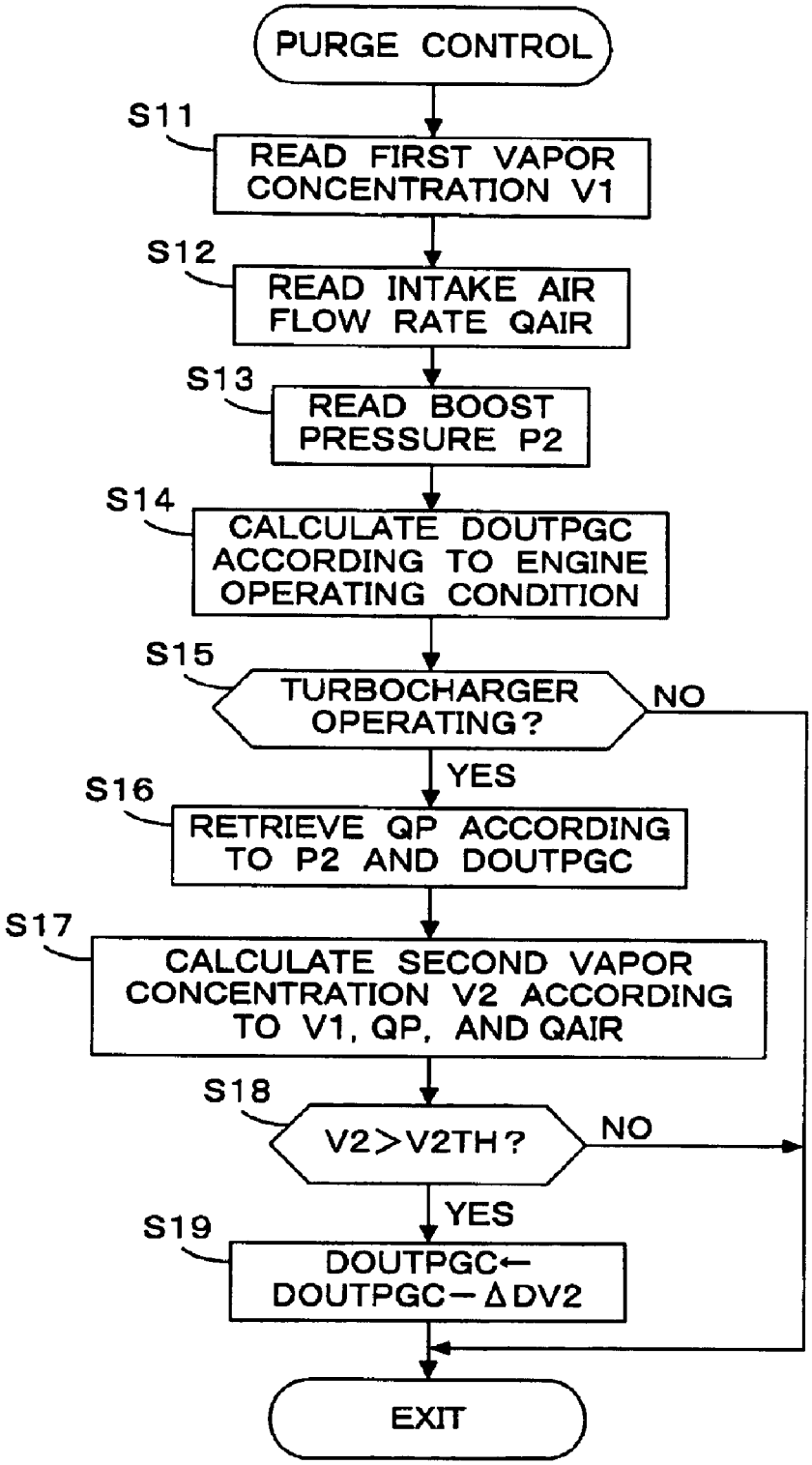
FIG. 4 is a flow chart of a process for controlling an opening of a purge control valve in accordance with the present invention.

FIG. 4 is a flow chart of a process for calculating the duty-ratio DOUTPGC, which can be embodied on a computer readable medium. This process is executed at predetermined time intervals (for example, 10 milliseconds) by the CPU in the ECU 9.

In steps S11–S13, the first vapor concentration V1, the intake air flow rate QAIR, and the boost pressure P2, which are detected by the sensors, are read in. In step S14, the duty-ratio DOUTPGC is calculated according to the engine operating condition. Specifically, the duty-ratio DOUTPGC is calculated according to the intake air flow rate QAIR, and limited within the range of values which have a minimal influence on the operation of the engine 1.

In step S15, it is determined whether or not the turbocharger 5 is operating. If the turbocharger 5 is not operating, this process immediately ends. If the turbocharger 5 is operating, the process proceeds to step S16, in which a QP map is retrieved according to the boost pressure P2 and the duty-ratio DOUTPGC to calculate the purge flow rate QP. The negative pressure generated in the jet pump 17 becomes large and the purge flow rate QP increases, as the boost pressure P2 becomes higher. Further, the purge flow rate QP increases, as the duty-ratio DOUTPGC becomes large. Therefore, the purge flow rate QP corresponding to the boost pressure P2 and the duty-ratio DOUTPGC is preliminarily set in the QP map.

In step S17, the first vapor concentration V1 [%], the purge flow rate QP [liter/min], and the intake air flow rate QAIR [liter/min] are applied to the following equation to calculate a second vapor concentration V2 [%]. The second vapor concentration V2 is an evaporative-fuel concentration (volume concentration) at a portion upstream of the turbocharger 5 in the intake pipe 2.

$$V2=QP\times V1/QAIR$$

In step S18, it is determined whether or not the second vapor concentration V2 is greater than a predetermined concentration V2TH (for example, 1.2%). If the answer to this step is negative (NO), this process immediately ends. If the second vapor concentration V2 is greater than the predetermined concentration V2TH, the duty-ratio DOUTPGC is corrected to decrease by a predetermined amount ΔDV2 in step S19.

The flammability limit volume concentrations of main ingredients contained in gasoline are provided below. In this embodiment, the predetermined concentration V2TH is set corresponding to the lower limit concentration of 1.2% of Hexane that has the lowest flammability limit volume concentration.

Hexane 1.2–7.4%

Butane 1.8–8.4%

Propane 2.1–9.4%

According to the process of FIG. 4, when the turbocharger 5 is operating, the second vapor concentration V2, which is an evaporative-fuel concentration at a portion of the intake pipe 2 upstream of the turbocharger 5, is calculated. If the second vapor concentration V2 is greater than the predetermined concentration V2TH, the duty-ratio DOUTPGC is corrected by being decreased. Therefore, the second vapor concentration (intake evaporative-fuel concentration) V2 is always controlled to a value less than or equal to the predetermined concentration V2TH, thereby preventing ignition of the air-fuel mixture containing the evaporative fuel.

In this embodiment, the evaporative-fuel concentration sensor 19, the boost pressure sensor 8, and the intake air flow rate sensor 7 correspond respectively to the evaporative-fuel concentration detection means, the boost pressure detecting means, and the intake air flow rate detecting means. The ECU 9 includes the purge control means 28 and the intake evaporative-fuel concentration calculating means 29. Specifically, steps S14, S15, S18, and S19 of FIG. 4 correspond to the purge control means 28. Steps S11–S13, S16, and S17 of FIG. 4 correspond to the intake evaporative-fuel concentration calculating means 29.

The present invention is not limited to the embodiment described above, and various modifications may be made. For example, in the above-described embodiment, the evaporative-fuel concentration sensor 19 for detecting the first vapor concentration V1 is disposed in the passage 16. Alternatively, the evaporative-fuel concentration sensor 19 may be disposed in the passage 15 or the first purge passage 13.

Further, if an oxygen concentration sensor is disposed in the exhaust system of the engine 1, an air-fuel ratio correction coefficient can be calculated according to the output of the oxygen concentration sensor, and a fuel amount supplied to the engine 1 can be corrected with the air-fuel ratio correction coefficient, the intake evaporative-fuel concentration V2 may be estimated based on a value of the air-fuel ratio correction coefficient calculated during execution of the evaporative-fuel purge.

Figure 5:
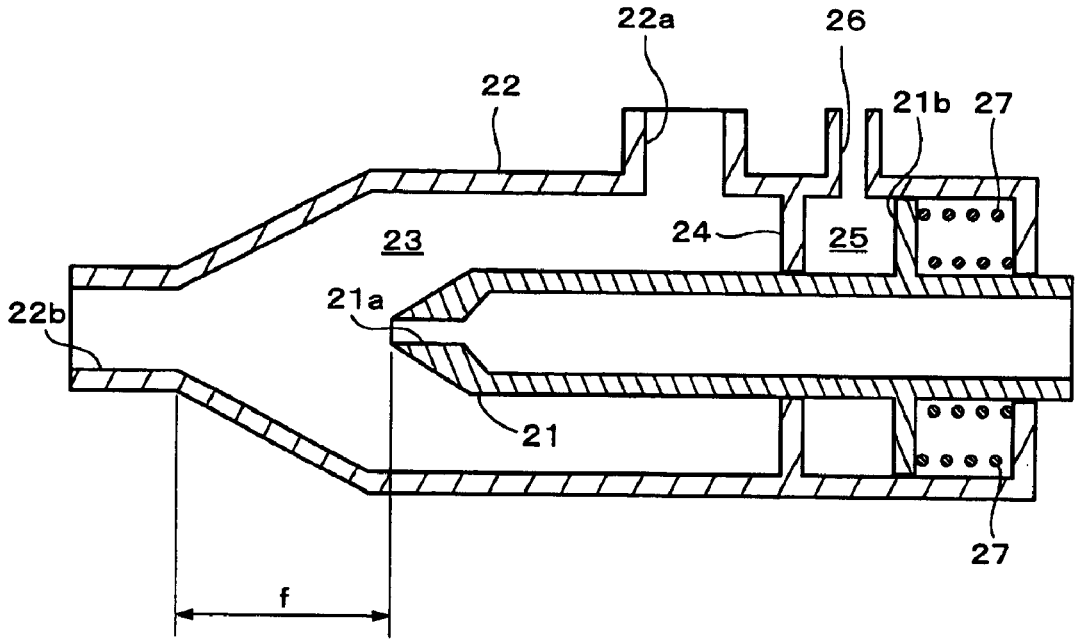
FIG. 5 is a sectional view showing a configuration of a modified jet pump in accordance with the present invention.

FIG. 5 is a sectional view showing a configuration of a modification of the jet pump 17 shown in FIG. 2. In FIG. 5, the nozzle 21 is provided with a flange 21*b*, and the casing 22 is provided with a partition 24. The flange 21*b* and the partition 24 define a pressure chamber 25 between the casing 22 and the nozzle 21. The pressure chamber 25 is provided with a pressurized air supply port 26, and configured so that the air pressurized by the turbocharger 5 may flow into the pressure chamber 25 through the pressurized air supply port 26. Further, between the flange 21*b* and the casing 22, springs 27 are inserted. The springs 27 bias the flange 21*b* leftward of FIG. 5 (in the direction of making the nozzle 21 close to the exhaust port 22*b*). Furthermore, the nozzle 21 is slidably fitted in the casing 22.

The partition 24, the flange 21*b*, the pressure chamber 25, the pressurized air supply port 26, and the springs 27 constitute a focal length changing mechanism. A focal length f, as shown in FIG. 5, defines a distance from the tip of the nozzle 21 to the entrance of the exhaust port 22*b*. According to the focal length changing mechanism, as the pressure in the pressure chamber 25 becomes higher, the nozzle 21 moves away from the exhaust port 22*b*, and the focal length f becomes longer.

Figure 6:
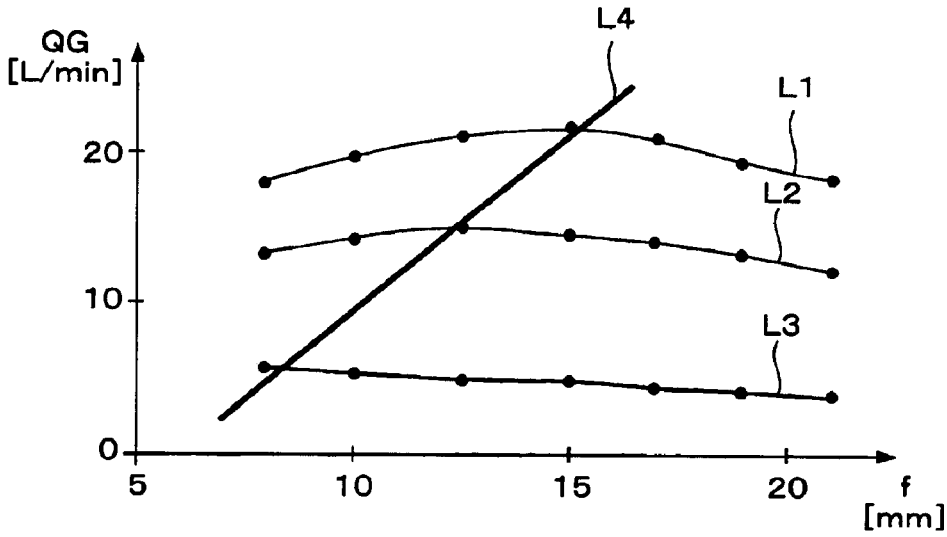
FIG. 6 is a graph showing a relationship between a focal length (f) and a generated gas flow rate (QG) in accordance with the present invention.

FIG. 6 shows a relationship between the focal length f and a flow rate QG of the generated gas flow. When the pressure of air being discharged from the nozzle 21 takes values of, for example only, 148 kPa, 128 kPa, and 108 kPa, the relationship between the parameters f and QG is given respectively by the lines L1, L2, and L3. If defining an optimal focal length fOPT as a focal length at which the generated gas flow rate QG is at a maximum, the optimal focal length tends to become longer, as the pressurized air pressure becomes higher. That is, the line L4 of FIG. 6 indicates a change in the optimal focal length fOPT corresponding to a change in the air pressure.

Therefore, by changing the focal length f according to the pressurized air pressure with the focal length changing mechanism described above, the maximum purge flow rate can always be obtained.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An evaporative fuel processing system including a fuel tank, a canister for temporarily storing evaporative fuel generated in said fuel tank, a charge passage connecting said fuel tank and said canister, a first purge passage connecting said canister and an intake pipe of an internal combustion engine having a turbocharger, and a purge control valve provided in said first purge passage for adjusting a flow rate of gases flowing through said first purge passage, said evaporative fuel processing system comprising:

a second purge passage connecting a downstream side of said purge control valve of said first purge passage and an upstream side of said turbocharger of said intake pipe;

a jet pump mounted on said second purge passage; and a pressurized air supply passage for supplying air pressurized by said turbocharger to said jet pump;

wherein said jet pump includes a nozzle for discharging pressurized air supplied through said pressurized air supply passage, and a casing surrounding said nozzle with a space, and said space being a part of said second purge passage.

2. An evaporative fuel processing system according to claim 1, wherein said nozzle of said jet pump is slidably fitted in said casing, and a discharge aperture of said nozzle moves away from an exhaust port of said jet pump as a pressure of the pressurized air becomes higher.

3. An evaporative fuel processing system according to claim 2, wherein said nozzle has a flange, and said flange and said casing define a pressure chamber, at least one spring being inserted between said flange and said casing so that said nozzle is biased toward said exhaust port of said jet pump, and the air pressurized by said turbocharger being supplied to said pressure chamber.

4. An evaporative fuel processing system according to claim 1, further comprising:

purge control means for controlling an opening of said purge control valve according to an operating condition of said engine;

evaporative-fuel concentration detecting means for detecting an evaporative-fuel concentration in an air-fuel mixture containing evaporative fuel emitted from said canister;

boost pressure detecting means for detecting a boost pressure of said turbocharger;

intake air flow rate detecting means for detecting an intake air flow rate of said engine; and evaporative-fuel concentration calculating means for calculating an evaporative-fuel concentration in the air-fuel mixture at an upstream side of said turbocharger as an intake evaporative-fuel concentration, according to the detected evaporative-fuel concentration, boost pressure, and intake air flow rate, wherein said purge control means decreases the opening of said purge control valve when the intake evaporative-fuel concentration exceeds a predetermined concentration during operation of said turbocharger.

5. An evaporative fuel processing system according to claim 4, wherein the predetermined concentration is set corresponding to a minimum value of flammability limit concentrations of ingredients contained in the evaporative fuel.

6. A control method for an evaporative fuel processing system including a fuel tank, a canister for temporarily storing evaporative fuel generated in said fuel tank, a charge passage connecting said fuel tank and said canister, a first purge passage connecting said canister and an intake pipe of an internal combustion engine having a turbocharger, and a purge control valve provided in said first purge passage for adjusting a flow rate of gases flowing through said first purge passage, said evaporative fuel processing system further including:

a second purge passage connecting a downstream side of said purge control valve of said first purge passage and an upstream side of said turbocharger of said intake pipe;

a jet pump mounted on said second purge passage; and a pressurized air supply passage for supplying air pressurized by said turbocharger to said jet pump;

said jet pump including a nozzle for discharging pressurized air supplied through said pressurized air supply passage, and a casing surrounding said nozzle with a space, said space being a part of said second purge passage, said control method comprising the steps of:

a) detecting an evaporative-fuel concentration in an air-fuel mixture containing evaporative fuel emitted from said canister;

b) detecting an intake air flow rate of said engine;

c) detecting a boost pressure of said turbocharger;

d) calculating an evaporative-fuel concentration in the air-fuel mixture at an upstream side of said turbocharger as an intake evaporative-fuel concentration, according to a detected evaporative-fuel concentration, boost pressure, and intake air flow rate; and e) controlling an opening of said purge control valve according to an operating condition of said engine, f) correcting the opening of said purge control valve in a decreasing direction when the intake evaporative-fuel concentration exceeds a predetermined concentration during operation of said turbocharger.

7. A control method according to claim 6, wherein the predetermined concentration is set corresponding to a minimum value of flammability limit concentrations of ingredients contained in the evaporative fuel.

8. A computer-readable medium encoded with a computer program for causing a computer to carry out a control method for an evaporative fuel processing system including a fuel tank, a canister for temporarily storing evaporative fuel generated in said fuel tank, a charge passage connecting said fuel tank and said canister, a first purge passage connecting said canister and an intake pipe of an internal combustion engine having a turbocharger, and a purge control valve provided in said first purge passage for adjusting a flow rate of gases flowing through said first purge passage, said evaporative fuel processing system further including:

a second purge passage connecting a downstream side of said purge control valve of said first purge passage and an upstream side of said turbocharger of said intake pipe;

a jet pump mounted on said second purge passage; and a pressurized air supply passage for supplying air pressurized by said turbocharger to said jet pump;

said jet pump including a nozzle for discharging pressurized air supplied through said pressurized air supply passage, and a casing surrounding said nozzle with a space, and said space constituting a part of said second purge passage, said control method comprising the steps of:

a) detecting an evaporative-fuel concentration in an air-fuel mixture containing evaporative fuel emitted from said canister;

b) detecting an intake air flow rate of said engine;

c) detecting a boost pressure of said turbocharger;

d) calculating an evaporative-fuel concentration in the air-fuel mixture at an upstream side of said turbocharger as an intake evaporative-fuel concentration, according to a detected evaporative-fuel concentration, boost pressure, and intake air flow rate; and e) controlling an opening of said purge control valve according to an operating condition of said engine, f) decreasing the opening of said purge control valve when the intake evaporative-fuel concentration exceeds a predetermined concentration during operation of said turbocharger.

9. A computer readable medium according to claim 8, wherein the predetermined concentration is set corresponding to a minimum value of flammability limit concentrations of ingredients contained in the evaporative fuel.

* * * * *